United States Patent [19]

Liu et al.

[11] Patent Number: 5,041,024

[45] Date of Patent: Aug. 20, 1991

[54] ADAPTER CONNECTOR WITH IMPROVED ELECTRIC SHIELDING PROPERTY

[75] Inventors: Yun-Yu Liu; Hsiao-Lei Shih, both of Taipei, Taiwan

[73] Assignee: Pan-International Industrial Corp., Taipei-Hsien, Taiwan

[21] Appl. No.: 603,605

[22] Filed: Oct. 26, 1990

[51] Int. Cl.[5] ..... H01R 25/00

[52] U.S. Cl. ..... 439/654; 439/609

[58] Field of Search ..... 439/607-610, 439/650, 651, 654, 686, 687, 695, 696, 689, 691, 708, 723, 724, 787, 796

[56] References Cited

U.S. PATENT DOCUMENTS

| | | | |
|---|---|---|---|
| 2,962,688 | 11/1960 | Werner | 439/654 |
| 4,650,270 | 3/1987 | Tajima et al. | 439/607 |
| 4,904,208 | 2/1990 | Powell | 439/654 |
| 4,906,200 | 3/1990 | Miyake | 439/607 |
| 4,938,714 | 7/1990 | Kawai et al. | 439/609 |

*Primary Examiner*—David L. Pirlot

*Attorney, Agent, or Firm*—Fleit, Jacobson, Cohn, Price, Holman & Stern

[57] ABSTRACT

An adapter connector with improved electric shielding property, comprising two symmetrical receptacles respectively connected to an adapter at two opposite sides and fastened inside a copper sleeve. The adapter is comprised of two symmetrical blocks connected side by side through stub mortise-and-tenon joint with two arched strip conductors fastened therein for alternative connection thereto of the two terminals of each receptacle to form an electric circuit. A plurality of beads are made on the inner wall of the copper sleeve and longitudinally aligned with each other for guiding the receptacles through a slide way so that the plug pins of one receptacle can be conveniently electrically connected to and inserted inside the plug pins of the other receptacle permitting the plug pins of the other receptacle to press against the inner wall of the copper sleeve for grounding.

2 Claims, 5 Drawing Sheets

ADAPTER CONNECTOR WITH IMPROVED ELECTRIC SHIELDING PROPERTY

BACKGROUND OF THE INVENTION

The present invention relates to adapter connectors, and more particularly relates to an adapter connector which is comprised of two opposite receptacles respectively electrically connected together via an adapter and received inside a copper sleeve and which can be conveniently assembled without soldering.

FIG. 1 illustrates an adapter connector according to the prior art, which is generally comprised of two opposite receptacles (a) respectively connected together and longitudinally covered with two opposite pairs of semi-circular plates (b). The terminals (c) of each receptacle (a) are bent into curved shapes such so that the terminals of one receptacle can interlock with the terminals (c) of the other receptacle. Before connection, the plug pins on the circular metal sleeve (d) must be properly cut so that the terminals (c) of one receptacle can be smoothly connected to the terminals (c) of the other. Because there are no means for securing the terminals (c), the terminals (c) must be soldered to provide an electrical connection. Further, the two semi-circular plates (b) each have a contact strip (e) projecting inwards so as to provide as ground connection with the circular metal (d). After assembly, the contact strip (e) must be soldered securely to the circular metal sleeve (d) to provide a connection, and the two semi-circular plates (a) should also be soldered or welded together to ensure good electric shielding effect. In order to bear the pressure of the outer insulator, the semi-circular plates (b) must be made of reinforced steel or the thickness of the steel plate used must be appropriately increased. Therefore, this type of conventional adapter connector is very complicated and expensive to manufacture.

SUMMARY OF THE PRESENT INVENTION

The goal of the present invention is to eliminate the aforesaid problems. According to one aspect of the present invention, an adapter connector is comprised of two symmetrical receptacles respectively connected to an adapter at two opposite sides and fastened inside a copper sleeve, wherein the adapter is comprised of two symmetrical blocks connected side by side with two arched strip conductors fastened therein and disposed across each other for easy connection of the terminals of the two symmetrical receptacles to form an electric circuit without going through a soldering operation.

According to another aspect of the present invention, an adapter connector is comprised of two symmetrical receptacles respectively connected to an adapter at two opposite sides and fastened inside a copper sleeve. The copper sleeve has a plurality of unitary beads on the inner wall and longitudinally aligned with each other for guiding the receptacles through a slideway so that the plug pins of one receptacle can be conveniently electrically connected to and inserted inside the plug pins of the other receptacle permitting the plug pins of the other receptacle to simultaneously press against the inner wall of the copper sleeve for grounding.

BRIEF DESCRIPTION OF THE DRAWINGS

The present invention will now be described by way of example only, with reference to the annexed drawings, in which.

DETAILED DESCRIPTION OF THE PREFERRED EMBODIMENT

Figure 1:
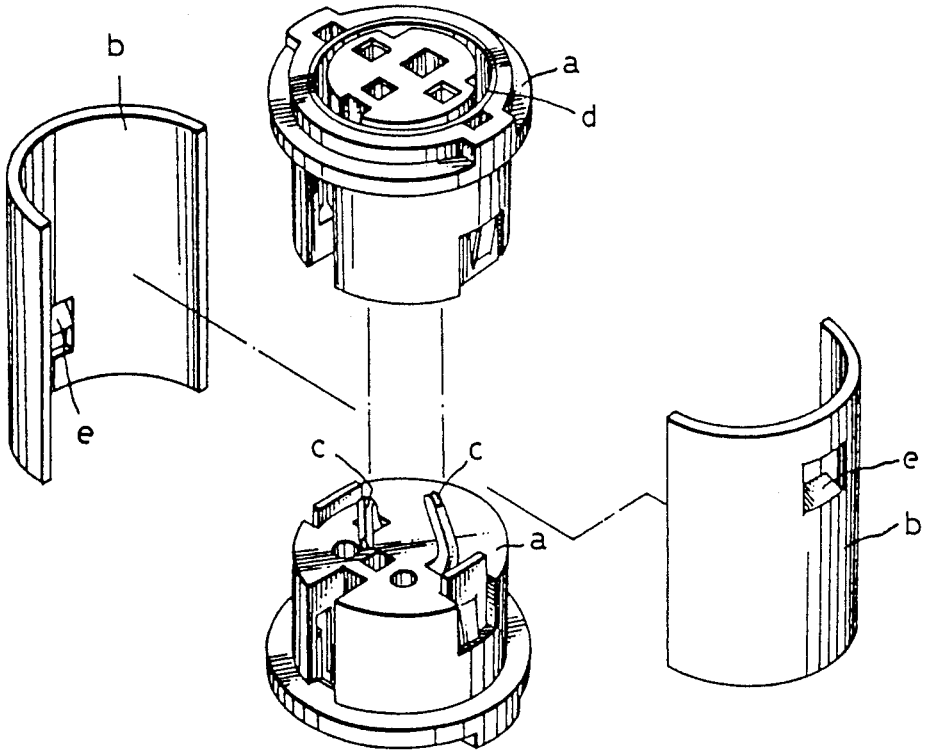
FIG. 1 (PRIOR ART)
FIG. 1 is a perspective dismantled view of an adapter connector according to the prior art.
Figure 2:
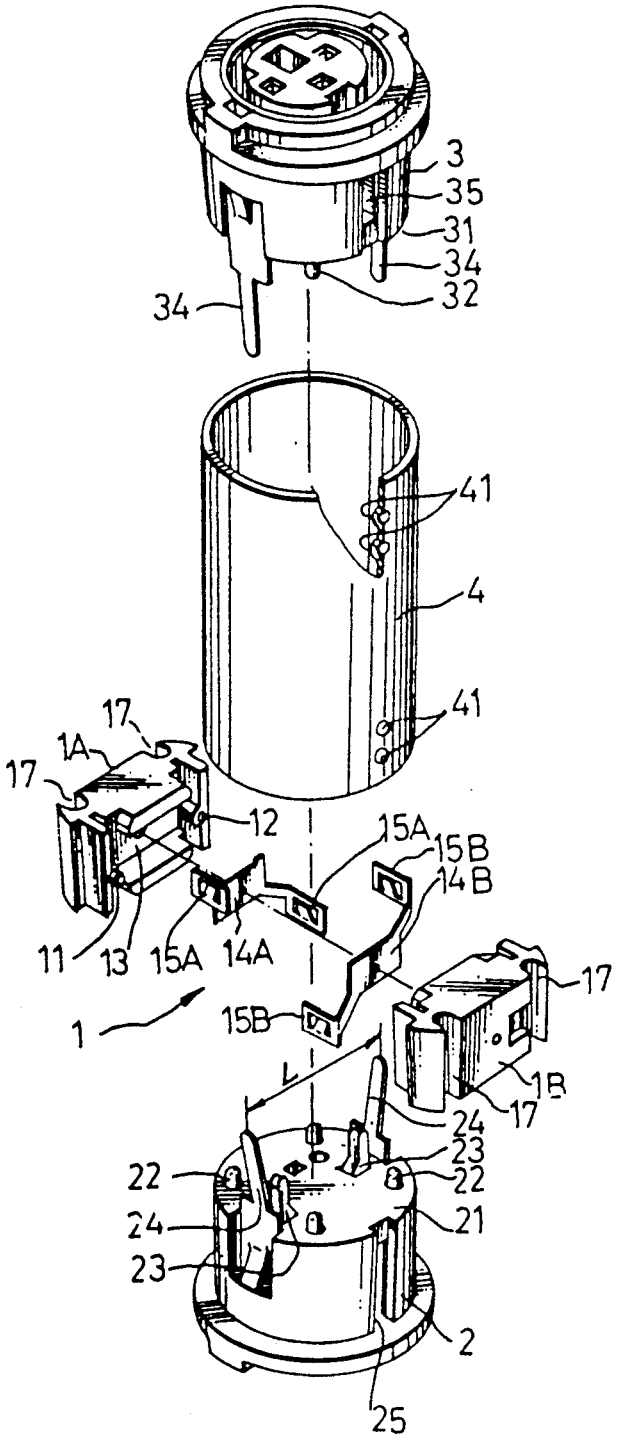
FIG. 2 is a perspective dismantled view of an adapter connector embodying the present invention.
Figure 3:
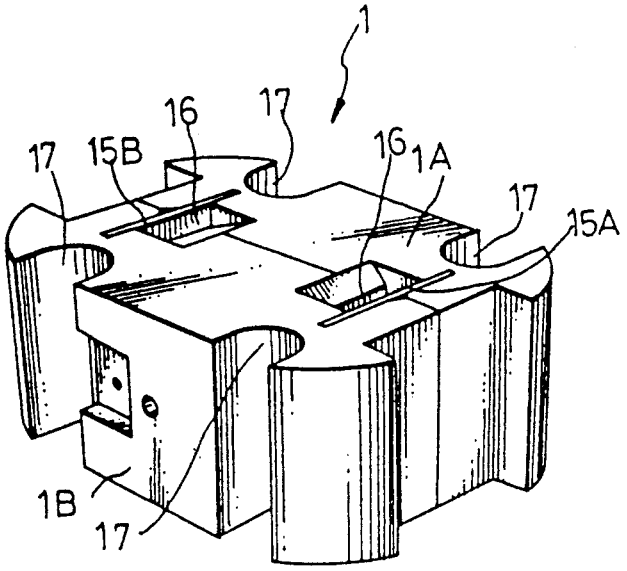
FIG. 3 is a perspective assembled view of the adapter of the adapter connector according to the present invention.

Referring to FIG. 2, there is illustrated an adapter connector according to present invention and generally comprised of an adapter 1, two opposite receptacles 2 and 3, and a copper sleeve 4. The adapter 1 is comprised of two symmetrical blocks 1A and 1B having each at lest a tenon 11 and a stub mortise so that one can be connected with the other side by side through stub mortise-and-tenon joint. A notch 13 is made on each symmetrical block 1A or 1B at the connecting side for holding an arched strip conductor 14A or 14B which has two opposite contact terminals 15A or 15B disposed at two opposite sides inside the notch 13. After the two symmetrical blocks 1A and 1B are connected together forming an adapter 1, the notch 13 of the first block 1A incorporates with the notch 13 of the second block 1B to define two opposite plug holes 16 (see FIG. 3), permitting the contact terminals 15A and 15B to be disposed in reverse direction against each other. There are to parallel grooves 17 vertically made on each symmetrical block 1A or 1B opposite to the connecting side.

The two receptacles 2 and 3 are connected to the adapter 1 at two opposite sides, having each two opposite pairs of tenons 22 or 32 on the connecting end 21 or 31 corresponding to the parallel grooves 17 on the adapter 1. Two opposite terminals 23 or 33 and two opposite plug pins 24 or 34 are respectively made on the connecting end 21 or 31 of each receptacle 2 or 3. Before assembly, the two opposite plug pins 24 on the first receptacle 2 are bent to slightly extend outwards. However, the length L between the top ends of the two opposite plug pins 24 must not exceed the inner diameter of the copper sleeve 4 so that the receptacle 2 can be conveniently fastened inside the copper sleeve 4. Further, there is a slideway 25 or 35 vertically made on the side wall of each receptacle 2 or 3. The copper sleeve 4 comprises a plurality of unitary beads 41 arranged in a vertical line on the inner wall surface thereof for guiding the receptacles 2 and 3 in position when they are respectively fastened therein.

Figure 4:
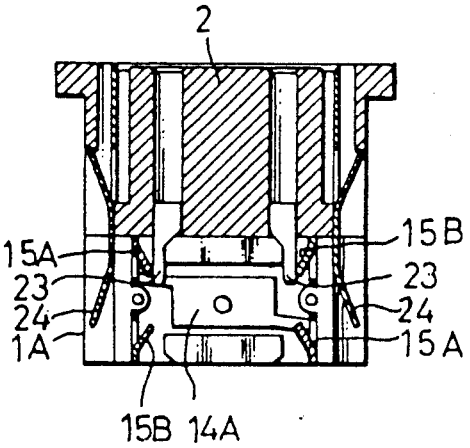
FIG. 4 is a sectional assembly view, showing the connection of the first receptacle with the adapter according to the present invention.
Figure 5:
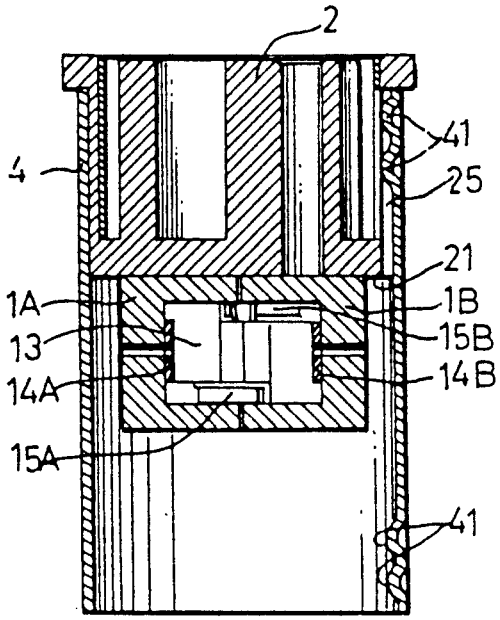
FIG. 5 is another sectional assembly view, showing the connection of the first receptacle and the adapter with the copper sleeve according to the present invention.
Figure 6:
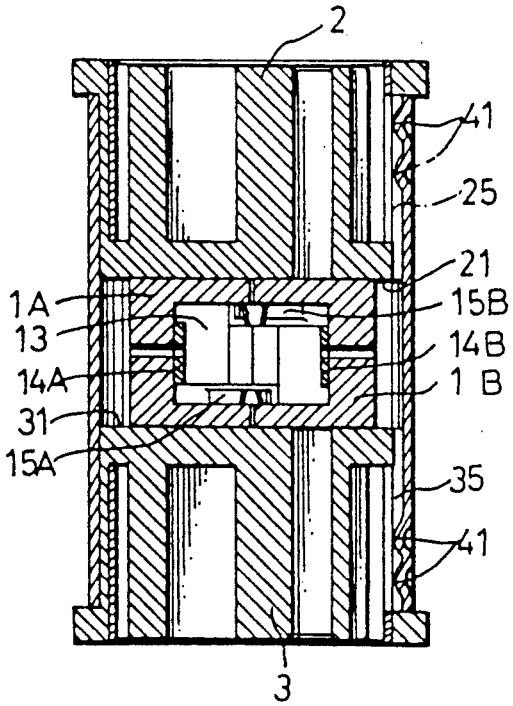
FIG. 6 is a longitudinal sectional assembly view of the present invention.
Figure 7:
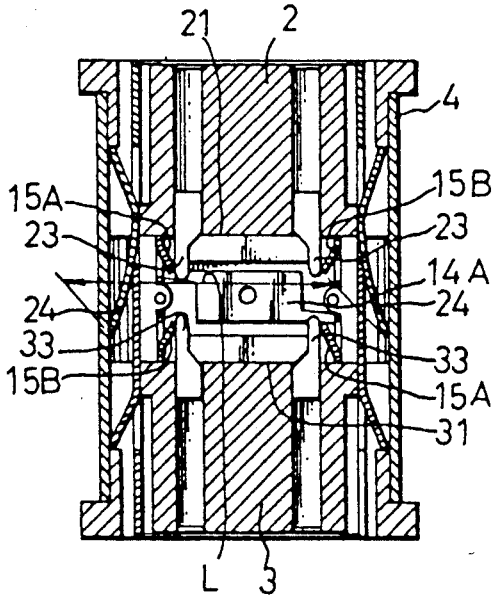
FIG. 7 is another longitudinal sectional assembly view of the present invention.

During assembly, the tenons 22 on the connecting end 21 of the first receptacle 2 are respectively inserted in the two parallel grooves 17 of the two symmetrical block 1A and 1B of the adapter 1, and the two opposite terminals 23 of the first receptacle 2 are respectively inserted in the plug holes 16 to contact the contact terminals 15A and 15B of the arched strip conductors 14A and 14B (see FIG. 4). Because of the engagement of the tenons 22 and the terminals 23 respectively in the grooves 17 and the plug holes 16, the first receptacle 2 can be firmly efficiently secured to the adapter 1. After the first receptacle 2 is attached to the adapter 1,, they are then fastened in the copper sleeve 41 from one end, permitting the beads 41 to sit in the slideway 25 of the first receptacle 2 (see FIG. 5). The second receptacle 3 is then fastened in the copper sleeve 4 from the opposite end. By means of the design of the slide way 35, the second receptacle 3 can be smoothly guided by the beads 41 to attach to the adapter 1 permitting the tenons 32 and the terminals 33 on its connecting end 31 to be respectively fastened in the grooves 17 and the plug holes 16. Therefore, the present invention can be conveniently assembled without performing any soldering. Because the terminals 33 of the second receptacle 3 are inserted from the opposite side of the adapter 1 into the plug holes 16 to electrically connect with the contact terminals 15A and 15B of the arched strip conductors 14A and 14B, as shown in FIG. 6, they are respectively connected to the terminals 23 of the first receptacle 2 in reverse direction via the other contact terminals 15A and 15B to form a circuit (see FIG. 6). Therefore, terminals need not to be bent obliquely for a reverse connection, and consequently, need for soldering is eliminated. By means of the guiding of the beads 41, the plug pins 24 and 34 are accurately connected to each other. Because the plug pins 24 of the first receptacle 2 are slightly obliquely extending outwards, the plug pins 34 of the second receptacle 3 can be attached to the plug pins 24 of the first receptacle 2 at the inner side so as to simultaneously force the plug pins 24 of the first receptacle 2 to outwardly press against the inner wall surface of the copper sleeve 4 for further connection to the ground (see FIG. 7).

In a general, the goal of the present invention is to provide an adapter connector having numerous features each of which tends to make the structure inexpensive to manufacture and more convenient to assemble without either soldering or welding.

We claim:

1. An adapter connector, comprising:

an adapter comprised of two symmetrical blocks connected together side by side, said symmetrical blocks having each at least a stub mortise and a tenon at a connecting side permitting one symmetrical block to connect with the other through a stub mortise-and-tenon joint, a notch on said connecting side for holding an arched strip conductor, said arched strip conductor having two opposite contact terminals at two opposite ends, two parallel grooves on opposite sides thereof against said connecting side;

two symmetrical receptacles having each a connecting end respectively connected to said adapter at two opposite sides, and a slideway longitudinally aligned with each other, said connecting end having made thereon two opposite pairs of tenons, two opposite terminals and two opposite plug pins;

a copper sleeve having a plurality of unitary beads raised from an inner wall surface and arranged in a vertical line; and wherein the notch of one symmetrical block cooperates with the notch of the other symmetrical block defining therein two oppoiste plug holes for insertion of the terminals of said two symmetrical receptacles from two opposite ends when said slideway is guided by said beads and the stub mortises on the connecting end of said symmetrical blocks are respectively inserted in the parallel grooves of said adapter from two opposite ends.

2. The adapter connector of claim 1, wherein two opposite plug pins of one of said two symmetrical receptacles are vertically disposed in parallel with each other and two opposite plug pins of the other receptacle are slightly extending outwards to an extent not exceeding the range of the inner diameter of said copper sleeve, so that the plug pins of one receptacle can be electrically connected to and inserted inside the plug pins of the other receptacle permitting the plug pins of the other receptacle to simultaneously press against the inner wall of said copper sleeve for earthing.

* * * * *